US009107457B2

(12) United States Patent
Wang

(10) Patent No.: US 9,107,457 B2
(45) Date of Patent: Aug. 18, 2015

(54) BREAST ENLARGEMENT SIMULATOR

(71) Applicant: Zhongtang Wang, Xiamen (CN)

(72) Inventor: Zhongtang Wang, Xiamen (CN)

( * ) Notice: Subject to any disclaimer, the term of this patent is extended or adjusted under 35 U.S.C. 154(b) by 0 days.

(21) Appl. No.: 14/292,794

(22) Filed: May 30, 2014

(65) Prior Publication Data

US 2014/0370783 A1 Dec. 18, 2014

(30) Foreign Application Priority Data

Jun. 17, 2013 (CN) ..... 2013 2 0344778 U
Nov. 8, 2013 (CN) ..... 2013 2 0701751 U

(51) Int. Cl.
*A41C 3/00* (2006.01)
*A41C 3/10* (2006.01)
*A41C 3/14* (2006.01)

(52) U.S. Cl.
CPC ..... *A41C 3/105* (2013.01); *A41C 3/0064* (2013.01); *A41C 3/148* (2013.01); *A41C 3/0028* (2013.01); *A41C 3/146* (2013.01)

(58) Field of Classification Search
CPC ..... A41C 3/00; A41C 3/005; A41C 3/0064; A41C 3/10; A41C 3/105; A41C 3/14; A41C 3/144; A41C 3/146; A41C 3/148
USPC ..... 450/38, 54–57
See application file for complete search history.

(56) References Cited

U.S. PATENT DOCUMENTS

| | | | | | |
|---|---|---|---|---|---|
| 76,894 | A * | 4/1868 | Cook | 450/38 |
| 579,824 | A * | 3/1897 | Harrison | 450/38 |
| 599,180 | A * | 12/1917 | Harrison | 450/38 |
| 2,764,759 | A * | 10/1956 | Gazelle | 450/38 |
| 3,326,218 | A * | 6/1967 | McAlpine | 450/38 |
| 5,347,656 | A * | 9/1994 | Fabritz et al. | 2/67 |
| 6,080,037 | A * | 6/2000 | Lee et al. | 450/38 |
| 6,302,760 | B1 * | 10/2001 | Dai | 450/38 |
| 6,354,906 | B1 * | 3/2002 | Liu | 450/38 |
| 6,461,221 | B1 * | 10/2002 | Stilwell et al. | 450/57 |
| 7,879,091 | B1 * | 2/2011 | Martin et al. | 623/7 |
| 7,942,722 | B2 * | 5/2011 | Tseng | 450/38 |
| 2010/0029176 | A1 * | 2/2010 | Chen et al. | 450/38 |
| 2011/0065358 | A1 * | 3/2011 | Fleeton | 450/38 |

* cited by examiner

*Primary Examiner* — Gloria Hale

(57) ABSTRACT

A breast enlargement simulator comprises two cups and elastic expansion bags. The two cups are provided and configured with a specification equal to that of a normal brassiere matched with breast convexity. The elastic expansion bag arranged in front of each cup comprises an inner cavity and a substrate having a profile dimensionally matched with that of the cup. The adjustment of desired breast enlargement effect can be adjusted by injecting air or water into the elastic expansion bag, thus to stimulatingly obtain the continuous adjustable dynamic effect. The patient can conveniently wear the elastic expansion bag over a long period of time. As the expect effect of desired breast enlargement can be simulated by the breast enlargement simulator of the invention, the patient is willing to agree the breast enlargement surgery, viz authorizing the medical institutes to do the breast enlargement surgery, and postoperative effect satisfaction can be promoted.

15 Claims, 2 Drawing Sheets

BREAST ENLARGEMENT SIMULATOR

BACKGROUND OF THE INVENTION

1. Field of the Invention

The present invention relates to a beauty and therapy device, and in particular relates to a breast enlargement simulator.

2. Description of the Related Art

Before breast enlargement surgery, prosthetic breast enlargement and autologous fat filling breast enlargement shall be simulated to attain expect effects, thus to instruct how to select required breast prosthetic size and shape at each side or judging a predetermined filling fat mass. Two following conventional methods related are provided.

In the first method, by wearing a brassiere with predetermined cups and stuffing different sizes of breast prostheses into the cups to observe the effect of the breast prostheses in front of a dressing mirror, the patient can basically determine whether the volume of the breast prostheses required is fit or not. It can be appreciated that the arrangement of the different sizes of breast prostheses cannot provide a continuous, arbitrary adjustment of breast enlargement, and breast prosthetic samples are very expensive and most conventional medical beauty institutes cannot afford to pay such a price. Besides, due to the design of flat bottom of breast prostheses and breast convexity of the patient, the selected breast prostheses for simulation cannot be fully attached on the patient's breasts, viz cavities must be formed therebetween, constantly resulting in that the selected breast prostheses have 20% on volume less than the perfect one.

In the second method, by placing a ball-shaped skin soft tissue expanders into a brassier with predetermined cups and injecting air into an expansion bag in front of a dressing mirror, the patient can determine whether the volume of the breast prostheses required is fit or not. It can be appreciated that the size of the expansion bag can be continuously adjusted. However, due to breast convexity of the patient, the selected breast prostheses for simulation could hardly be fully attached on the patient's breasts, viz larger cavities formed therebetween, resulting in that the selected breast prostheses has more volume lesser than the perfect one.

BRIEF SUMMARY OF THE INVENTION

The main purpose of the invention is to provide a breast enlargement simulator with a simple structure and convenient operations, capable of being fully attached on female breasts, stimulatingly obtaining the continuous adjustable dynamic effect, and correctly approaching the patient's requirements on breast enlargement.

To attain the above purposes, the solution of the invention is to provide a breast enlargement simulator.

The breast enlargement simulator comprises two cups and elastic expansion bags. The two cups are provided and configured with a specification equal to that of a normal brassiere matched with breast convexity. The elastic expansion bag arranged in front of each cup comprises an inner cavity and a substrate having a profile dimensionally matched with that of the cup.

The substrate of the elastic expansion bag is a concave disk having a radian identical to the cup.

The elastic expansion bag is formed of a rounded or water drop shape.

The cup is made of elastic silicon material.

The elastic expansion bag is made of elastic silicon material.

The elastic expansion bag comprises wall thickened regions.

The wall thickened regions of the elastic expansion bag are corresponding to two sides of the cups.

A rigid baffle board is disposed on a region where the substrate of the elastic expansion bag is corresponding to the wall thickened regions thereof.

Each elastic expansion bag is connected with an injection conduit having one end connected to an injection pot.

The breast enlargement simulator comprises a bottom shroud which is provided with a hanging button and connected to the two cups and shoulder straps which are disposed on top portions of the two cups and connected to the bottom shroud.

The bottom shroud is detachably connected to the two cups and shoulder straps.

The substrate of the elastic expansion bag is a concave disk having a radian identical to the cup.

The injection conduit is connected to an outer edge of the elastic expansion bag near to a bag-entering opening located at an outer side of the cup.

The injection pot is assembled by a one-way valve.

The one-way valve is disposed on the bag-entering opening of the elastic expansion bag.

Based on the application of the above solutions, the breast enlargement simulator of the invention, cooperating with the brassiere structure, different specifications of cups and the adjustable elastic expansion bags disposed in front of the cups, can obtain the adjustment of desired breast enlargement effect that is realized by adding the injected air or water to the elastic expansion bag after the injector is pierced into the wall thickened regions of the elastic expansion bag or by adding the injected air or water to the elastic expansion bag from the injection pot, thus to stimulatingly obtain the continuous adjustable dynamic effect. Further, with the fitting, clearance-free of between the silicone cups and human body and the substrate of the elastic expansion bags to be dimensionally matched with the cups, the patient's requirements on the size and shape of enlarged breast before breast enlargement surgery can be satisfactorily acquired. Further, air or water contained in the elastic expansion bag does not leak when the injector is pierced into the elastic expansion bag or after the pierced injector is pulled out of the elastic expansion bag. The patient can conveniently wear the elastic expansion bag over a long period of time. Besides, in the operation, the expect effect of the desired breast enlargement can be simulated by injecting or drawing air or water into or out of the elastic expansion bag, not affecting patient's daily life. The breast enlargement simulator of the invention is durable and reusable.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Implementations of the present invention are illustrated with references to the accompanying drawings.

Figure 1:
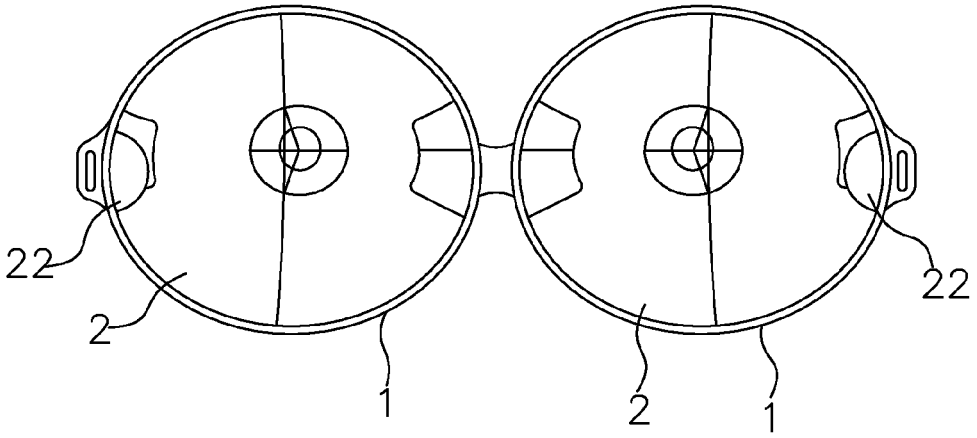
FIG. 1 is a main view of a breast enlargement simulator of a first embodiment of the invention.
Figure 2:
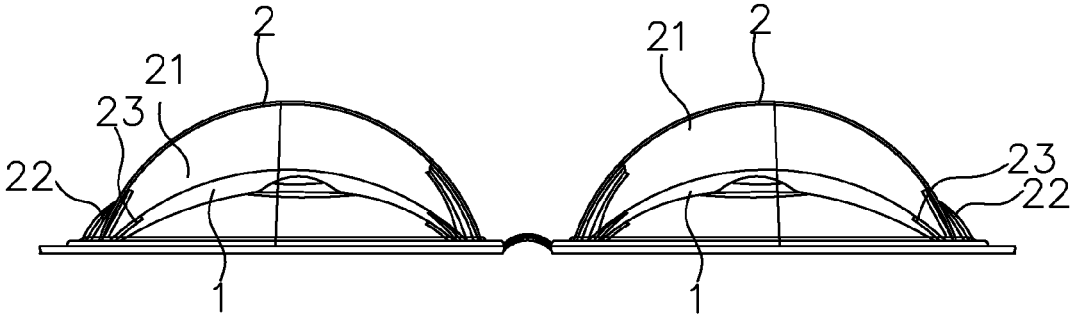
FIG. 2 is a structural sectional view of the breast enlargement simulator of the first embodiment of the invention.

As shown in FIGS. 1 and 2, a breast enlargement simulator of a first embodiment of the invention is a brassiere structure comprising two cups 1, a bottom shroud (not shown in FIGs.) which is provided with a hanging button and connected to the two cups 1, and shoulder straps (not shown in FIGs.) which are disposed on top portions of the two cups 1 and connected to the bottom shroud. In this embodiment, the brassiere can be provided with detachable, hidden shoulder straps and bottom shroud, or the brassiere can be formed without shoulder strap and bottom shroud, viz only cups. The cups 1 are configured with a specification equal to that of a normal brassiere matched with breast convexity. The cup 1 is made of elastic silicon material. An elastic expansion bag 2 arranged in front of each cup 1 comprises an inner cavity 21 and a substrate having a profile dimensionally matched with that of the cup 1. The substrate of the elastic expansion bag 2 is a concave disk having a radian identical to the cup 1. The elastic expansion bag 2 can be formed of a rounded or water drop shape.

The cup 1 is selectively made of elastic silicon material. Besides, the cup 1 can be made of other elastic or soft materials that are capable of offering comforts and avoiding deformation when air or water is injected into the elastic expansion bag 2. The elastic expansion bag 2 can be selectively made of elastic silicon material.

By injecting air or water into the inner cavity 21 of the cup 1 through an injector that is applied to pierce an outer wall of the elastic expansion bag 2, the patient who wears the breast enlargement simulator provided with parametrically matched cups 1 can observe in front of a dressing mirror by means of adding or drawing the injected air or water into or out of the elastic expansion bag 2, to eventually acquire a satisfactory size and shape of enlarged breast before breast enlargement surgery. That is, a summation of the volume of the injected air or water and the volume of the silicone cups 1 equals the required breast prosthetic volume, or the self-material volume or synthetic material required to be injected and stuffed. The patient, who wears the breast enlargement simulator containing adequate injected water or air to be placed under the brassiere or without brassiere outside, capable of adjusting amount of air or water if necessary. Accordingly, the patient can assure themselves of size and shape of enlarged breast before breast enlargement surgery.

With the property of elastic materials, air or water contained in the elastic expansion bag 2 does not leak when the injector is pierced into the elastic expansion bag 2 or after the pierced injector is pulled out of the elastic expansion bag 2.

For providing the breast enlargement simulator with guaranteed ideal life service and usage effect, the elastic expansion bag 2 can further comprise wall thickened regions 22, and the wall thickened regions 22 can be located at any places of the elastic expansion bag 2. In this embodiment, the thickened regions 22 are artistically configured at regions corresponding to two sides of the cups 1, viz not spoiling the outlook of the breast enlargement simulator. With the configuration of the wall thickened regions 22 of the elastic expansion bag 2, the wall thickened regions 22 of the elastic expansion bag 2 can be repeatedly pierced for over 200 times without leakage, viz this breast enlargement simulator provided with the wall thickened regions 22 of the elastic expansion bag 2 can be continuously applied at least 200 person-time. Besides, for providing the breast enlargement simulator with guaranteed implementation security and avoiding of a needle of the injector to pierce through a conjunction of the elastic expansion bag 2 and the cup, a rigid baffle board 23 is further disposed on a region where the substrate of the elastic expansion bag 2 is corresponding to the wall thickened regions 22 thereof. Therefore, when the needle of the injector is pierced in the inner cavity 21 of the elastic expansion bag 2, the rigid baffle board 23 can be utilized to stop the needle of the injector from piercing through the cup 1, or to prevent the needle of the injector from puncturing the patient.

Figure 3:
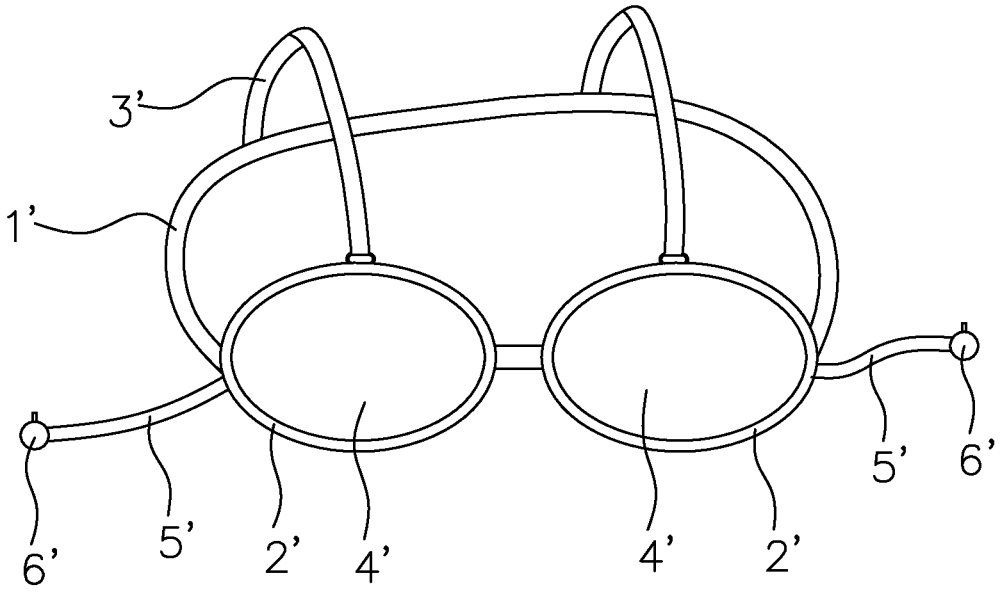
FIG. 3 is a schematic view of a breast enlargement simulator of a second embodiment of the invention.
Figure 4:
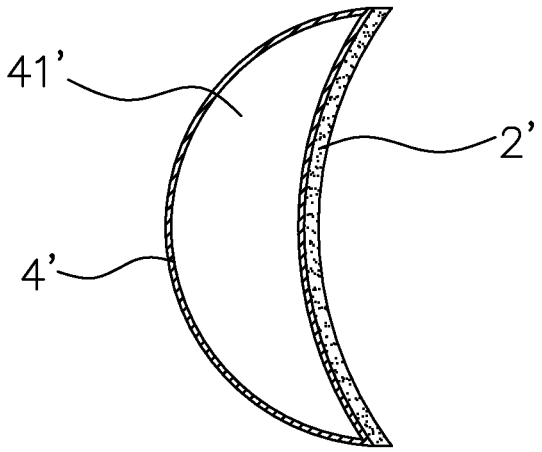
FIG. 4 is a structural sectional view of the breast enlargement simulator of the second embodiment of the invention.

As shown in FIGS. 3 and 4, a breast enlargement simulator of a second embodiment of the invention is a brassiere structure comprising a bottom shroud 1' provided with a hanging button, two cups 2' connected to the bottom shroud 1', and shoulder straps 3' disposed on top portions of the two cups 2' to connect the bottom shroud 1'. In this embodiment, the brassiere can be provided with detachable, hidden shoulder straps and bottom shroud, or the brassiere can be formed without shoulder strap and bottom shroud, viz only cups. The two cups 2' made of elastic silicon material are configured with a specification equal to that of a normal brassiere matched with breast convexity. An elastic expansion bag 4' arranged in front of each cup 2' comprises an inner cavity 41' and a substrate having a profile dimensionally matched with that of the cup 2'. That is, the substrate of the elastic expansion bag 4' is a concave disk having a radian identical to the cup 2'. Each elastic expansion bag 4' is connected with an injection conduit 5' having one end connected to an injection pot 6'.

The cup 2' is selectively made of elastic silicon material. Besides, the cup 2' can be made of other elastic or soft materials that are capable of offering comforts and avoiding deformation when air or water is injected into the elastic expansion bag 4'.

The injection conduit 5' is connected to an outer edge of the elastic expansion bag 4' near to a bag-entering opening located at an outer side of the cup 2'.

The injection pot 6' is assembled by a one-way valve, capable of realizing the repetition of adding or drawing out the injected air or water to or from the elastic expansion bag 4'.

Generally, the one-way valve can be directly disposed on the bag-entering opening of the elastic expansion bag 4'.

By injecting air or water into the elastic expansion bag 4' from the injection pot 6' via the injection conduit 5', the patient who wears the breast enlargement simulator provided with parametrically matched cups 2' can observe in front of a dressing mirror by means of adding or drawing the injected air or water into or out of the elastic expansion bag 4', to eventually acquire a satisfactory size and shape of enlarged breast before breast enlargement surgery. That is, a summation of the volume of the injected air or water and the volume of the silicone cups 2' equals the required breast prosthetic volume, or the self-material volume or synthetic material required to be injected and stuffed. The patient, who wears the breast enlargement simulator containing adequate injected water or air to be placed under the brassiere or without brassiere outside, capable of adjusting amount of air or water if necessary. Accordingly, the patient can assure themselves of size and shape of enlarged breast before breast enlargement surgery.

In conclusion, the breast enlargement simulator of the invention, cooperating with the brassiere structure, different specifications of cups and the adjustable elastic expansion bags disposed in front of the cups, can obtain the adjustment of desired breast enlargement effect that is realized by adding the injected air or water to the elastic expansion bag after the injector is pierced into the wall thickened regions of the elastic expansion bag or by adding the injected air or water to the elastic expansion bag from the injection pot, thus to stimulatingly obtain the continuous adjustable dynamic effect. Further, with the fitting, clearance-free of between the silicone cups and human body and the substrate of the elastic expansion bags to be dimensionally matched with the cups, patient's requirements on the size and shape of enlarged breast before breast enlargement surgery can be satisfactorily acquired.

It can be appreciated that the invention provides the advantages as follows.

Firstly, the invention can be cooperatively matched with different cups of brassieres, providing advantages of close fitness, surface smoothness, flexible texture and convenient cleaning.

Secondly, with the elastic expansion bag to be arranged in front the cup, the substrate of the elastic expansion bag to be closely adhesively bonded to the front wall of the cup, and the diameter of the substrate of the elastic expansion bag to be matched with that of the cup, an accurate judgment on the size of breast prosthetic volume can be realized.

Thirdly, the elastic expansion bag, generally similar to conventional ball-shaped skin soft tissue expanders, differs from the conventional ball-shaped skin soft tissue expanders in that the substrate is a concave disk having a radian identical to the cup instead of spherical convex structure, capable of advancedly ensuring the accuracy of the selected breast enlargement prosthetic. Due to the elastic expansion bag to be made by elastic materials with varied thickness, the adjustment of desired breast enlargement effect can be realized.

Fourthly, due to the injection pot assembled by the one-way valve to be able to repeatedly inject or draw out the injected air, the size and shape of enlarged breast can be stimulatingly obtained by injecting air into the inner cavity of the cup, and the dynamic effect of the desired enlarged breast can be stimulatingly obtained by injecting water into the elastic expansion bag. Besides, the injection pot can be attachably connected with or without the injection conduit.

Fifthly, the cup is selectively made by medium-hardness silicone, capable of offering comforts and avoiding deformation to affect simulation result when injecting air or water into the elastic expansion bag.

Sixthly, the breast enlargement simulator of the invention can be reused.

Seventhly, the patient is willing to agree the breast enlargement surgery as the expect effect of desired breast enlargement simulated by the breast enlargement simulator of the invention can be personally experienced before breast enlargement surgery, and the doctor can therefore have more data while selecting the required breast prosthetic.

Eighthly, the elastic expansion bag of the invention can be formed of a rounded shape or sectioned shaped (water drop shape). The volume of the elastic expansion bag and the diameter of the cup are matched to human bodies with different sizes (e.g., large, medium and small sizes). The apparent color of the elastic expansion bag can be preserved original one thereof, or can be covered by skin color or others. Besides, the patient can conveniently wear the elastic expansion bag over a long period of time.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A breast enlargement simulator, characterized in that two cups are provided and each of the two cups is configured with a brassiere, and an elastic expansion bag concentrically arranged with one of the two cups comprises an inner cavity and a bottom, wherein the elastic expansion is reinforced i) at a top with a wall-strengthening region for an injector needle to pierce through into the inner cavity, and ii) at the bottom with a baffle board situated corresponding to the wall-strengthening region to block the injector needle from piercing through one of the two cups; and the elastic expansion bag is not communicating with each other.

2. The breast enlargement simulator as claimed in claim 1, characterized in that the breast enlargement simulator comprises a bottom torso band which is provided with a hanging button and connected to the two cups and shoulder straps which are disposed on top portions of the two cups and connected to the bottom torso band.

3. The breast enlargement simulator as claimed in claim 2, characterized in that the bottom torso band is detachably connected to the two cups and shoulder straps.

4. The breast enlargement simulator as claimed in claim 1, characterized in that the bottom of the elastic expansion bag is a concave disk.

5. The breast enlargement simulator as claimed in claim 1, characterized in that the elastic expansion bag is round.

6. The breast enlargement simulator as claimed in claim 1, characterized in that the cup is made of elastic silicon material.

7. The breast enlargement simulator as claimed in claim 1, characterized in that the elastic expansion bag is made of elastic silicon material.

8. The breast enlargement simulator as claimed in claim 1, characterized in that the wall-strengthening region of the elastic expansion bag is disposed at two sides of the cups.

9. The breast enlargement simulator as claimed in claim 1, characterized in that each elastic expansion bag is connected with an injection conduit having one end connected to an injection ort.

10. The breast enlargement simulator as claimed in claim 9, characterized in that the breast enlargement simulator comprises a bottom shroud which is provided with a hanging button and connected to the two cups and shoulder straps which are disposed on top portions of the two cups and connected to the bottom torso band.

11. The breast enlargement simulator as claimed in claim 10, characterized in that the bottom torso band is detachably connected to the two cups and shoulder straps.

12. The breast enlargement simulator as claimed in claim 9, characterized in that the substrate of the elastic expansion bag is a concave.

13. The breast enlargement simulator as claimed in claim 9, characterized in that the injection conduit is connected to an outer edge of the elastic expansion bag near to an outer side of the cup.

14. The breast enlargement simulator as claimed in claim 9, characterized in that the injection is assembled by a one-way valve.

15. The breast enlargement simulator as claimed in claim 9, characterized in that the elastic expansion bag comprises a bag-entering opening disposed with a one-way valve.

* * * * *